United States Patent [19]

Dresch et al.

[11] 4,110,548

[45] Aug. 29, 1978

[54] WATER-COOLED ELECTRODE HOLDER

[75] Inventors: Charles D. Dresch, Annville; Robert A. Yohe, Steelton, both of Pa.

[73] Assignee: Bethlehem Steel Corporation, Bethlehem, Pa.

[21] Appl. No.: 755,411

[22] Filed: Dec. 29, 1976

[51] Int. Cl.[2] ..... H05B 7/105

[52] U.S. Cl. ..... 13/16

[58] Field of Search ..... 13/14–17, 13/32; 174/15 R; 165/170

[56] References Cited

U.S. PATENT DOCUMENTS

| | | | |
|---|---|---|---|
| 1,795,934 | 3/1931 | Davis et al. | 13/32 X |
| 2,953,613 | 9/1960 | Keefer | 13/17 |
| 3,334,170 | 8/1967 | Turner | 13/16 |

*Primary Examiner*—R. N. Envall, Jr.
*Attorney, Agent, or Firm*—Joseph J. O'Keefe; Michael J. Delaney; Anson W. Biggs

[57] ABSTRACT

A mechanically formed copper base plate has recesses machined in it and cover plates sealed over these recesses. The base plate is bent into an incomplete sleeve and connected to support means containing opposed clamping means which cooperate with this sleeve to provide an electrode holder.

2 Claims, 5 Drawing Figures

FIG. 1
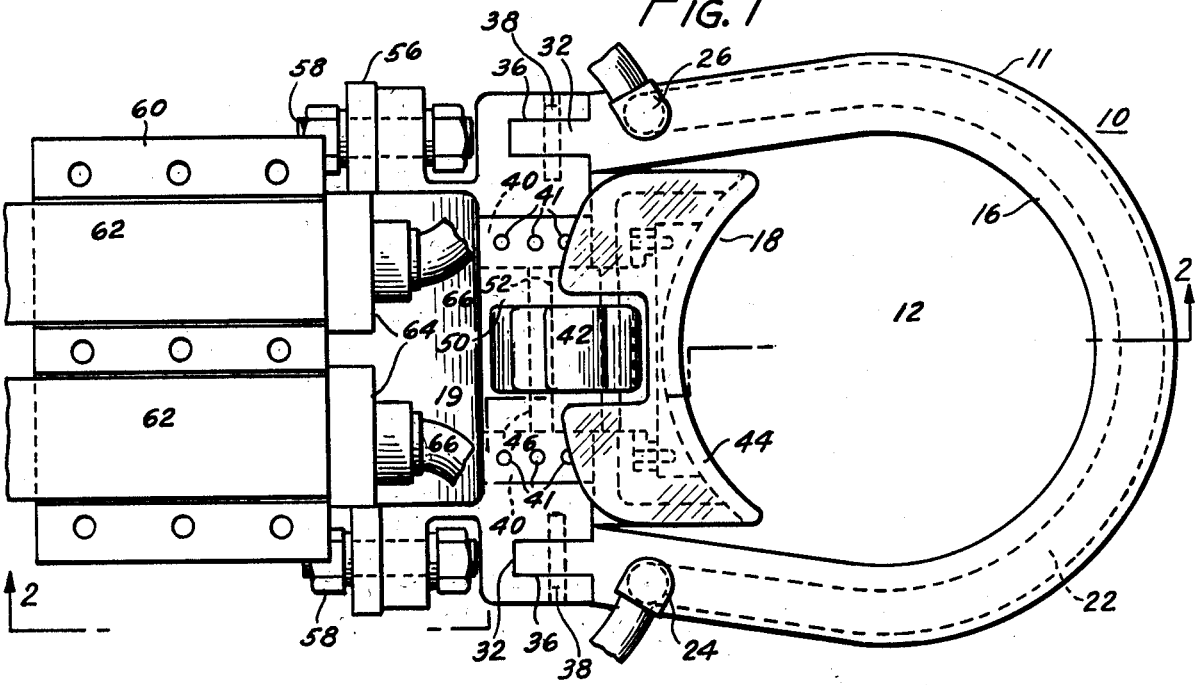
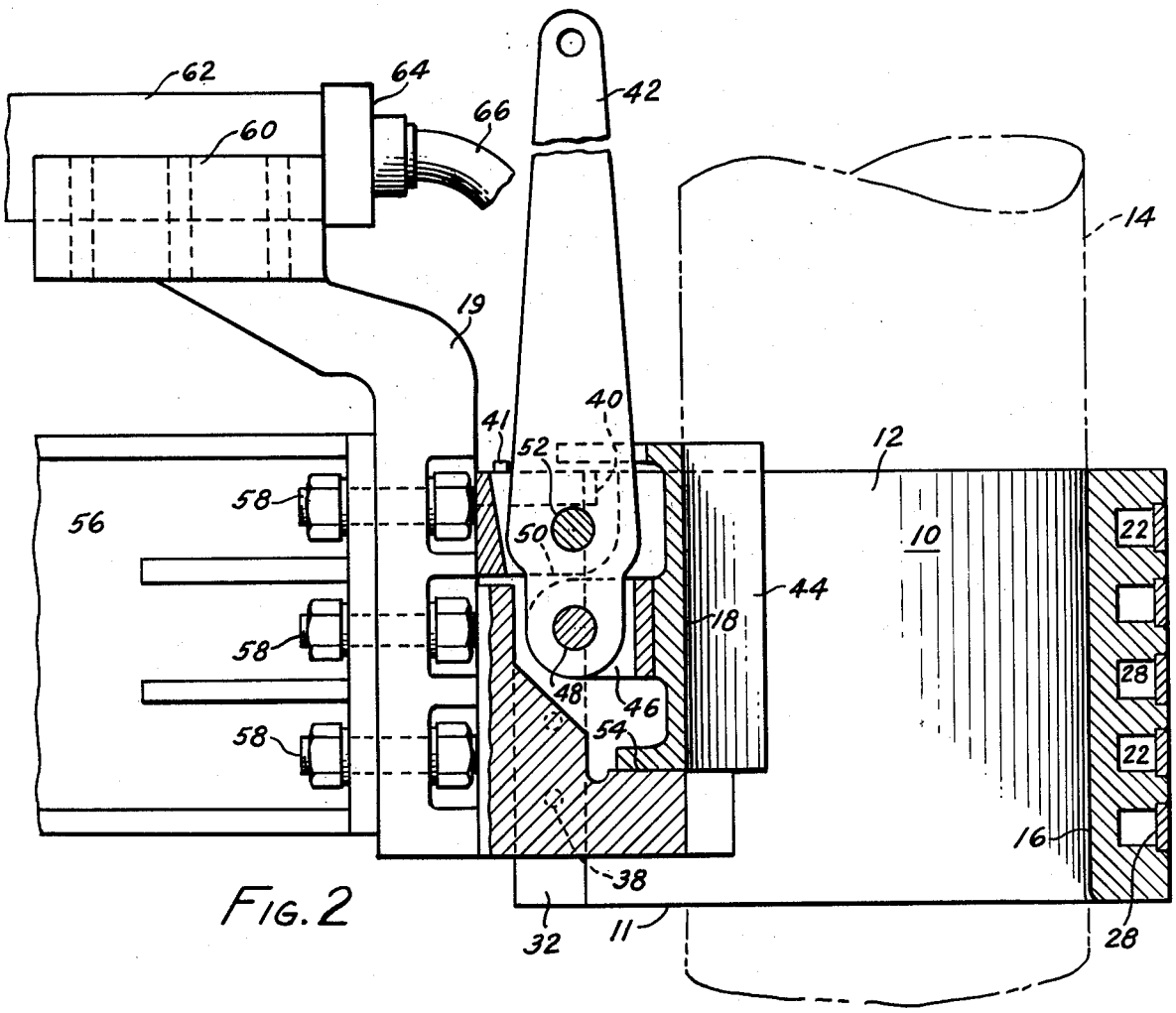
FIG. 2

FIG. 3
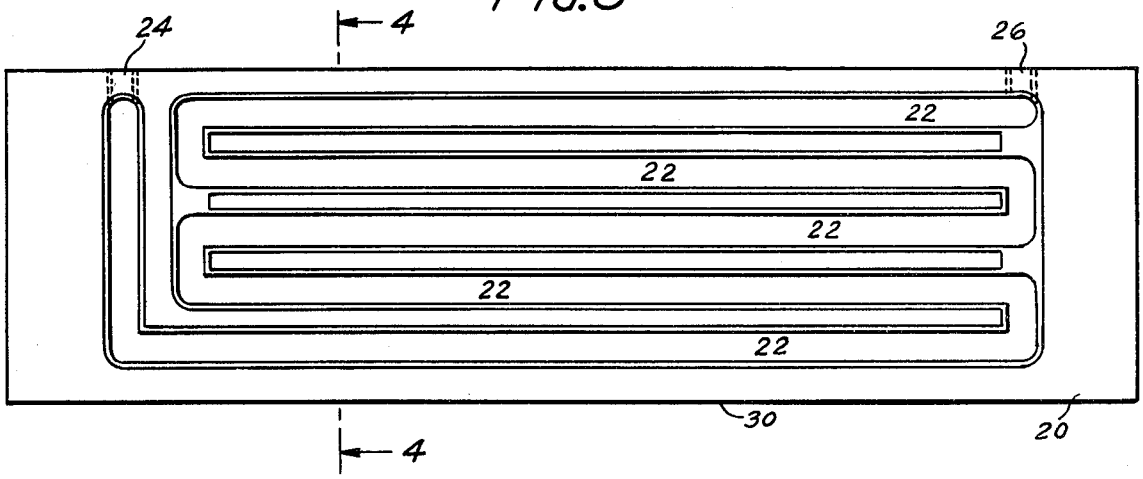
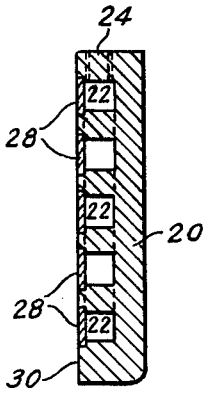
FIG. 4
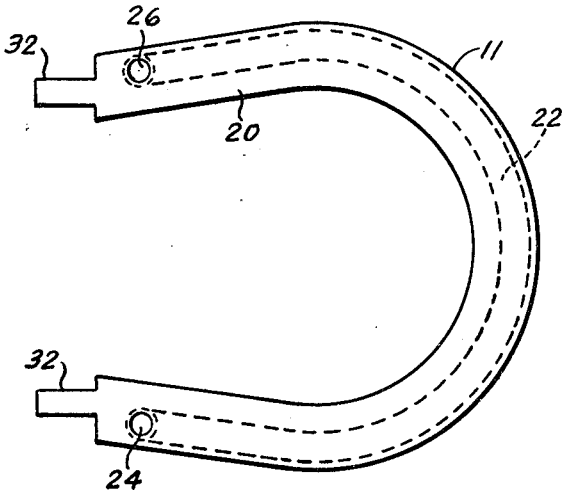
FIG. 5

WATER-COOLED ELECTRODE HOLDER

BACKGROUND OF THE INVENTION

This invention relates to a fluid-cooled member. More particularly, it relates to a water-cooled electrode holder.

In the past, water-cooled electrode holders have generally been made in one of two ways. First, cooling coils, made of Monel, for example, have been embedded directly in a copper casting. However, shrinkage of the casting during solidification resulted in areas of relatively poor contact between the cooling coils and the copper. Hence, the thermal conductivity between the coils and the casting was poor at these areas, and the cooling effectiveness of the coils was consequently less than satisfactory.

A second method of producing such a holder comprised casting the copper holder with the recesses already formed in them. It was found, however, that such holders were unsatisfactory for several reasons. First, if the grains of the casting were excessively large, which was not at all unusual, the coolant was likely to leak directly through the grain boundaries. In addition, such castings were frequently characterized by excessive porosity, which permitted coolant to pass directly to the surface of the casting through connected passages formed by air bubbles leaving the casting during solidification. Furthermore, such castings frequently cracked during service as a result of the heat generated by the large currents supplied to the electrodes.

More recently, electrode holders have been formed by welding an outer plate to a casting and providing arcuate inner plates between this outer plate and the casting to form passageways for the flow of coolant within the holder. However, there is no way to weld these inner plates to both the casting and the outer plate. Thus, inasmuch as the outer plate inevitably warps as a result of the continuous heating and cooling of the holder, considerable space develops between the edges of these inner plates and the walls they extend between. This results in poor definition of cooling paths and consequent ineffective cooling.

It is an object of this invention to provide a fluid-cooled member that is characterized by a high degree of cooling effectiveness.

It is a more specific object of this invention to provide such a member that forms part of an electrode holder.

SUMMARY OF THE INVENTION

I have discovered that the foregoing objects can be obtained by providing a mechanically formed metal base plate. The mechanical forming operation substantially eliminates porosity in the base, thus removing one potential cause of leakage. One wall of this metal base plate is provided with a plurality of connected recesses machined therein. These recesses are sealed by means of a plurality of mechanically formed metal cover plates welded over the recesses. Here again, the use of a mechanical forming operation eliminates porosity and removes one potential cause of leakage. A pair of ports is provided in the base plate leading to opposite ends of the connected recesses whereby a coolant may be circulated through the base plate.

Brief Description of the Drawings

FIG. 1 is a plan view of an electrode holder utilizing the invention.

FIG. 2 is a sectional view along the line 2—2 of FIG. 1.

FIG. 3 is a front elevation view of the holder base plate before being bent into an incomplete sleeve.

FIG. 4 is a sectional view along the lines 4—4 of FIG. 3.

FIG. 5 is a plan view of the holder base plate after being bent into an incomplete sleeve.

DESCRIPTION OF THE PREFERRED EMBODIMENT

As shown in the FIGS. 1 and 2, an electrode holder 10 is provided for use, for example, in an electric furnace. The holder 10 comprises an element generally in the shape of an incomplete sleeve 11 having an opening 12 into which a cylindrical electrode 14, shown in phantom, may pass. The opening 12 is generally circular and forms a cylindrical surface 16 through an arc of somewhat more than 180°. The remainder of the opening 12 is tapered as a result of the manner in which the sleeve 11 is connected to an intermediate member 19. Clamping means 18 provides a surface that opposes the cylindrical circular surfae 16. The electrode 14 is adapted to be held between these opposing surfaces.

The sleeve 11 is formed of a copper base plate 20, shown in FIGS. 3 and 4 prior to being bent into the shape of a sleeve, and shown in FIG. 5 after being so bent. As shown, the plate 20 is provided with a plurality of connected recesses 22, an inlet port 24, and an outlet port 26. The base plate 20 is also machined so as to receive mechanically formed copper cover plates 28, not shown in FIG. 3, with the outer surfaces of the cover plates 28 flush with the surface 30 of the base plate 20. These cover plates 28 are secured to base plate 20 by welding.

The ends 32 of the sleeve 11 are machined so as to fit into slots 36 in intermediate member 19, shown in FIGS. 1 and 2. The sleeve 11 is then dowel pinned to member 19 with two silica bronze pins 38 and the sleeve 11 and member 19 are welded together. Member 19 is provided with supporting surfaces 40 to which the clamping means 18 is attached by bolts 41. Means 18 comprises a lever arm 42 that is connected to power means (not shown) for actuation thereof. Means 18 further comprises a clamping sleeve 44 provided with a yoke 46 connected to lever 42 by pin 48. Another yoke 50 is affixed to member 19 and provides the pivot point for lever 42 by means of a pin 52. Actuation of the power means causes the arm 42 to pivot about pin 52 and causes clamping sleeve 44 to translate along bearing surface 54 of member 19.

Member 19 is bolted to an electrode holder arm 56 by bolts 58. This arm 56 is provided with means, not shown, for extending the holder 10 into a furnace and changing the vertical position of the holder 10 as the electrode is consumed, for example.

The upper portion of member 19 is provided with a saddle 60 that is adapted to receive a pair of water-cooled power bus tubes 62. The ends of these bus tubes are coupled by means of couplers 64 to hoses 66 that provide coolant to and from the ports 24 and 26 in sleeve 11.

I claim:

1. In apparatus for use with cylindrical electric furnace electrodes including a water cooled electrode holder, the improvement comprising:

(a) a flat single element having a plurality of connected recesses machined therein and bent to form a U-shape metal sleeve having an opening forming an arc of more than 180°, with the plurality of connected recesses provided in the outer wall of the metal sleeve, (b) a pair of ports in the U-shaped metal sleeve leading to opposite ends of the connected recesses whereby a coolant may be circulated through the connected recesses, and (c) means to seal the plurality of connected recesses against leakage.

2. Apparatus according to claim 1 wherein the means to seal the plurality of connected recesses includes a plurality of metal cover plates welded over the recesses with the outer surfaces of the cover plates flush with the surface of the sleeve.

* * * * *